US008042595B2

(12) United States Patent
Llagostera Forns

(10) Patent No.: US 8,042,595 B2
(45) Date of Patent: Oct. 25, 2011

(54) AWNING CASE ASSEMBLY

(75) Inventor: Joan Llagostera Forns, Reus (ES)

(73) Assignee: Llaza, S.A., Reus (Tarragona) (ES)

( * ) Notice: Subject to any disclaimer, the term of this patent is extended or adjusted under 35 U.S.C. 154(b) by 502 days.

(21) Appl. No.: 11/917,617

(22) PCT Filed: May 24, 2006

(86) PCT No.: PCT/ES2006/000279

§ 371 (c)(1),
(2), (4) Date: Nov. 13, 2008

(87) PCT Pub. No.: WO2006/131578

PCT Pub. Date: Dec. 14, 2006

(65) Prior Publication Data

US 2009/0199974 A1 Aug. 13, 2009

(30) Foreign Application Priority Data

Jun. 10, 2005 (ES) ..... 200501397

(51) Int. Cl.
*E04F 10/00* (2006.01)
*E04F 10/06* (2006.01)

(52) U.S. Cl. ..... 160/22; 160/66; 160/70

(58) Field of Classification Search ..... 160/22, 160/66, 70, 79
See application file for complete search history.

(56) References Cited

U.S. PATENT DOCUMENTS 3,187,370 A * 6/1965 Bieda ..... 16/87.6 R
4,258,778 A * 3/1981 Upton et al. ..... 160/383
4,469,159 A * 9/1984 Lohausen ..... 160/22
4,508,126 A * 4/1985 Everard ..... 160/67
4,566,516 A * 1/1986 Lohausen ..... 160/22
4,917,021 A * 4/1990 Murphy ..... 105/378
5,121,782 A * 6/1992 Renkhoff et al. ..... 160/22
5,333,663 A * 8/1994 Eger ..... 160/22
5,365,989 A * 11/1994 Eger et al. ..... 160/22
5,369,919 A * 12/1994 Lohausen ..... 52/73
5,394,921 A * 3/1995 Lohausen ..... 160/22
5,492,162 A * 2/1996 Lohausen ..... 160/22
5,673,739 A * 10/1997 Brutsaert ..... 160/22
5,839,491 A * 11/1998 Kroner et al. ..... 160/22

(Continued)

FOREIGN PATENT DOCUMENTS

DE 23 31 365 A1 1/1975

(Continued)

OTHER PUBLICATIONS

International Search Report for PCT International Application No. PCT/ES2006/000279 mailed Oct. 20, 2006.

*Primary Examiner* — Blair M Johnson
*Assistant Examiner* — Jaime F Cardenas-Garcia
(74) *Attorney, Agent, or Firm* — RatnerPrestia

(57) ABSTRACT

The invention relates to an awning case assembly including a housing for a winding tube for winding the canvas, a load bar fixed to a front edge of the canvas, and foldable arms hingedly connected to the housing and to the load bar. The load bar including a second longitudinal coupling configuration which can be coupled to a second longitudinal coupling edge of the housing to form a fulcrum line about which the load bar can rotate under the action of a pulling force exerted by the canvas until a first longitudinal coupling configuration of the load bar is coupled to a first longitudinal coupling edge of the housing, the first longitudinal coupling configuration being disposed at a distance from the second coupling configuration and adjacent to a canvas fixing configuration.

11 Claims, 4 Drawing Sheets

U.S. PATENT DOCUMENTS

| | | | | |
|---|---|---|---|---|
| 6,024,152 | A * | 2/2000 | Rosenich | 160/22 |
| 6,056,350 | A * | 5/2000 | Brutsaert | 296/163 |
| 6,739,371 | B2 * | 5/2004 | Mukai | 160/22 |
| 7,451,797 | B2 * | 11/2008 | Llagostera Forns | 160/79 |
| 7,604,036 | B2 * | 10/2009 | Thompson et al. | 160/22 |
| 2004/0188034 | A1 * | 9/2004 | Powell et al. | 160/70 |
| 2007/0051476 | A1 * | 3/2007 | Forns | 160/79 |

FOREIGN PATENT DOCUMENTS

| | | | |
|---|---|---|---|
| EP | 0 593 389 | B1 | 4/1994 |
| EP | 0 665 346 | A1 | 8/1995 |
| ES | 2 099 406 | | 5/1997 |
| ES | 2 179 904 | | 2/2003 |
| NL | 1006038 | C | 11/1998 |

* cited by examiner

AWNING CASE ASSEMBLY

This application is a U.S. National Phase application of PCT International Application No. PCT/ES2006/000279, filed May 24, 2006.

FIELD OF THE INVENTION

The present invention generally relates to an awning case assembly provided with a housing wherein a winding bar for winding the canvas is housed, a load bar to which a front edge of the canvas is fixed, and a pair of foldable arms connected at one end to the housing and at the other end to the load bar. In a folded awning situation, the load bar closes the housing with the wound canvas and the folded arms therein.

STATE OF THE PRIOR ART

A type of awning is well known comprising a canvas, a winding tube on which said canvas is wound, a load bar joined to a front end of the canvas, and extensible articulated arms connected to the load bar and elastically pushed to extend the canvas as it is unwound and to keep the canvas taut. A manual or motor-driven mechanism allows rotation of the winding tube so as to extend or draw in the canvas of the awning. It is also known to incorporate the canvas winding tube inside a case which can be closed to protect it. This case is generally formed by an elongated housing provided with a front longitudinal opening through which the canvas passes and by a load bar configured to close said longitudinal opening in a folded awning situation, wherein the arms are folded and housed inside the housing. The housing is closed at both side ends by end plates, each of which is rotatably coupled to a respective support part fixed in relation to a wall or another structure. Adjustment means allow adjusting and fixing the angular position of the end plates, and therefore of the case, with respect to the support parts. Positioning parts fixed inside the load bar collaborate in the correct positioning of the foldable arms inside the case in the closed case situation.

European patent EP 0593389 discloses a support device with adjustable inclination for an awning case having the features described above. Given that the load bar is supported by the foldable arms, and that the path of the movement of the load bar during a closing operation of the case is determined by the folding movement of the foldable arms, the coupling of the load bar with the front side of the housing during the last stage of the closing operation is inaccurate and the degree of tightness achieved is low. In an exemplary embodiment, the awning case housing includes an outer wall surrounding the winding bar and the canvas at the upper, lower and rear sides thereof, and an auxiliary part attached to the outer wall and forming a partition wall surrounding the winding bar and the canvas at the front side thereof except in the area of the longitudinal opening allowing the passage of the canvas. In the closed situation, said partition wall is interposed between the wound canvas and the forded arms without contact with the load bar.

Document NL 1006038 discloses an awning case comprising a housing for a winding bar with a canvas wound thereon and a load bar having a longitudinal fixing configuration to which a front end of the canvas is attached. The load bar is shaped so as to close a longitudinal opening of the housing in a closed situation. The opening of the housing is delimited by lower and upper longitudinal coupling edges, and the load bar comprises lower and upper coupling configurations arranged to couple with the lower and upper longitudinal coupling edges of the housing, respectively. From the figures can be deduced that, during a last stage of the closing operation, first the lower coupling configuration of the load bar is coupled to the lower coupling edge of the housing forming a fulcrum line about which the load bar can rotate under the pulling action of the canvas until the upper coupling configuration of the load bar is coupled to the upper coupling edge of the housing. However, a drawback with this construction is that the upper coupling configuration of the load bar is necessarily placed at a highest level than the longitudinal fixing configuration of the load bar to which the canvas is attached, and thus an upper portion of the load bar protrudes upwards from the canvas providing an obstacle susceptible to build-up rainwater, dust and other debris when the awning is open.

DISCLOSURE OF THE INVENTION

The present invention contributes to overcoming the previous and other drawbacks by providing an awning case assembly comprising a housing adapted to house a winding tube with a canvas wound thereon, said housing having a longitudinal opening allowing the passage of said canvas; and a load bar having a longitudinal fixing configuration to which a front edge of said canvas is fixed. The mentioned load bar is hingedly connected to distal ends of foldable arms having proximal ends hingedly connected to the housing. The load bar is adapted to be coupled to the housing in a folded awning situation, closing said longitudinal opening and covering said foldable arms. To that end, the load bar comprises a first longitudinal coupling configuration adjacent to said longitudinal fixing configuration and adapted to be coupled to a first longitudinal coupling edge of the housing, and a second longitudinal coupling configuration arranged at a distance from said first coupling configuration and adapted to be coupled to a second longitudinal coupling edge of the housing. Said first and second coupling configurations and said first and second coupling edges are arranged such that during a closing operation of the case by winding the canvas, the second coupling configuration of the load bar is first coupled to the second coupling edge of the housing, such as to form a fulcrum line about which the load bar can rotate under the action of a pulling force exerted by the canvas on the fixing configuration until the first coupling configuration is coupled to the first coupling edge of the housing.

The awning case assembly of the present invention is characterized in that the housing comprises an outer wall surrounding the winding tube and the canvas at the upper, lower and rear sides, and a partition wall surrounding the winding tube and the canvas at the front side except in the area of the longitudinal opening, said partition wall being placed between the canvas wound on the winding tube and the foldable arms in the folded awning situation, and the first coupling edge of the housing is formed at a free upper edge of said partition wall close to an upper front edge of said outer wall and separated therefrom by said longitudinal opening, and the second coupling edge of the housing is formed at a lower front edge of said outer wall.

With this construction, as the first longitudinal coupling edge of the housing is placed at the free upper end of the partition wall, below the longitudinal opening through which the canvas passes, the first longitudinal coupling configuration of the load bar is at a lower level than the longitudinal fixing configuration to which the canvas is attached. This enables to place the longitudinal fixing configuration at the uppermost level of the load bar thus avoiding or minimizing the possibility of building-up rainwater, dust and other debris when the awning is open.

The mentioned rotation of the load bar about said fulcrum line, which is feasible by a certain elasticity of the materials, is of a very small magnitude but is enough to ensure an accurate coupling and a relatively tight closing.

BRIEF DESCRIPTION OF THE DRAWINGS

The previous and other advantages and features will be better understood from the following detailed description of an exemplary embodiment with reference to the attached drawings, in which.

DETAILED DESCRIPTION OF AN EXEMPLARY EMBODIMENT

Figure 1:
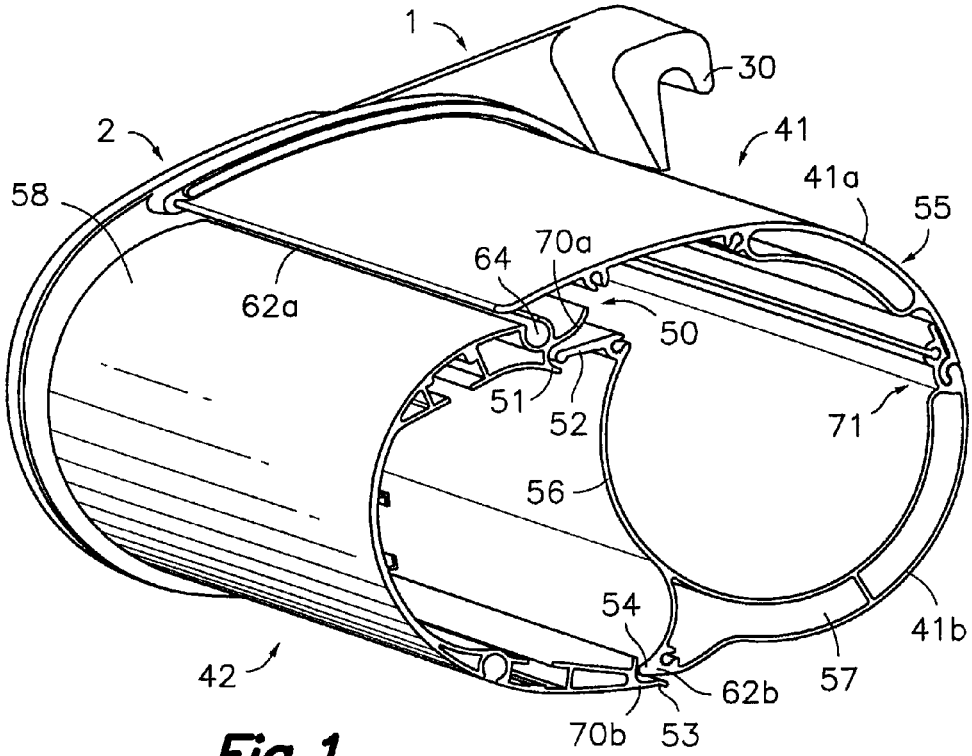
FIG. 1 is a partial perspective view of the awning case assembly according to an exemplary embodiment of the present invention, showing the sections of the housing and of the load bar.
Figure 2:
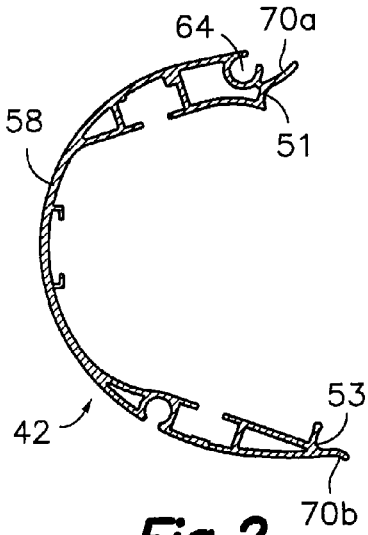
FIGS. 2 and 3 are cross-sectional views of the load bar and the housing, respectively.
Figure 3:
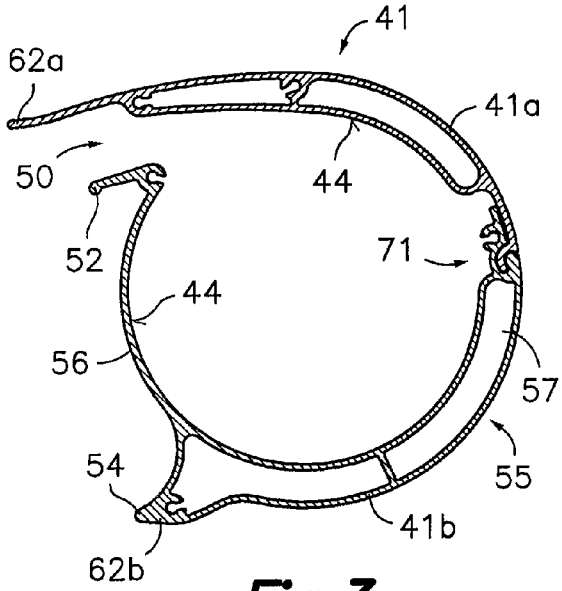

With reference first to FIGS. 1 to 3, the case 40 comprises a housing 41, individually shown in cross-section in FIG. 3, two end plates 2 to which said housing 41 is fixed at its ends, only one of said end plates 2 being visible in FIG. 1, and a load bar 42 individually shown in cross-section in FIG. 2. Each of the mentioned end plates 2 is rotatably coupled to a support part 1 fixed in relation to a wall or another structure, for example, by means of an anchoring part 32 (FIGS. 7A-7C) fixed to said wall or another structure, to which the support part is fixed by an engaging configuration 30 and a screw 43.

The housing 41 is adapted to house a winding tube 25 with the canvas 26 wound thereon (see also FIGS. 7A-7C) and has a longitudinal opening 50 allowing the passage of said canvas 26. The load bar 42 is fixed to a front edge of said canvas 26. The assembly includes a pair of foldable arms 24, each of which has a proximal end hingedly connected to the corresponding end plate 2, on a side opposite to the support part 1, and a distal end hingedly connected to the load bar 42. The load bar 42 is thus supported and guided by the foldable arms 24. As conventional, the foldable arms 24 are subjected to the force of elastic means (not shown) pushing the load bar 42 in a direction away from the housing 41. This force exerted by the elastic means is suitable to keep the canvas under tension whichever the position of the load bar 42.

The housing 41 comprises an outer wall 55 surrounding the winding tube 25 and the canvas 26 at the upper, lower and rear sides, and a partition wall 56 surrounding the winding tube 25 and the canvas 26 at the front side except in the area of the mentioned longitudinal opening 50. The outer wall 55 of the housing 41 is advantageously formed by two extruded profiles 41*a*, 41*b* of a lightweight metal material, such as an aluminium alloy. In this case, the extruded profiles 41*a*, 41*b* are longitudinally connected to one another along a connecting line 71. However, the outer wall 55 of the housing 41 could be formed from a single profile with an equivalent result. One part of the outer wall 55 is a double wall forming one or more chambers 57 therein which, apart from offering additional protection for the case, form important reinforcing and stiffening elements against bending and torsion. Inner surfaces of said outer wall 55 and of said partition wall 56 define a substantially cylindrical surface facing the canvas 26 wound on the winding tube 25 and they preferably include a coating 44 of plastic material with a low friction coefficient. In a folded awning situation (FIG. 7C) the partition wall 56 is thus placed between the canvas 26 wound on the winding tube 25 and the foldable arms 24.

As shown more clearly in FIG. 3, the outer wall 55 of the housing 41 has an upper front edge 62*a* and a lower front edge 62*b*. In the depicted exemplary embodiment, the partition wall 56 extends upwardly from said lower front edge 62*b* of the outer wall 55 and has a free upper edge in which a first coupling edge 52 of the housing 41 is longitudinally formed. This first coupling edge 52 of the housing 41 is located close to said upper front edge 62*a* of the outer wall 55 and separated therefrom by the longitudinal opening 50. A second coupling edge 54 of the housing 41 is longitudinally formed in the lower front edge 62*b* of said outer wall 55.

The load bar 42 is adapted to be coupled to the housing 41 in said folded awning situation, closing the longitudinal opening 50 and covering the foldable arms 24. To that end, as shown more clearly in FIG. 2, the load bar 42 comprises an externally convex closing wall 58 defining an inner hollow facing the winding tube 25, i.e., the partition wall 56, and which can at least partly house the foldable arms 24 in the folded awning situation. The mentioned closing wall 58 has an upper rear edge 70*a* and a lower rear edge 70*b*. A fixing configuration 64 adapted to fix said front edge of the canvas 26 by conventional means is longitudinally defined near said upper rear edge 70*a*, and a first coupling configuration 51 adapted to be coupled to the first coupling edge 52 of the housing 41 is longitudinally formed next to said fixing configuration 64. A second coupling configuration 53 is longitudinally formed next to said lower rear edge 70*b*, said second coupling configuration 53 being arranged at a distance from said first coupling configuration 51 and adapted to be coupled to said second longitudinal coupling edge 54 of the housing 41.

Although its use is not very common, in an exemplary embodiment not shown the case 40 has a reverse construction, such that the longitudinal opening for the passage of the canvas is located at the lower region of the housing and the arms are located above the canvas.

Figure 4:
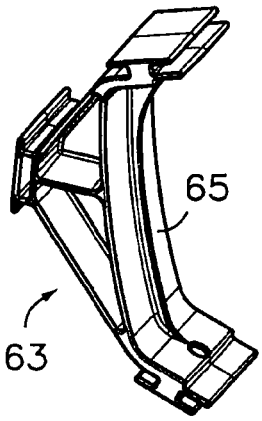
FIG. 4 is a perspective view of a reinforcing part of the load bar.
Figure 5:
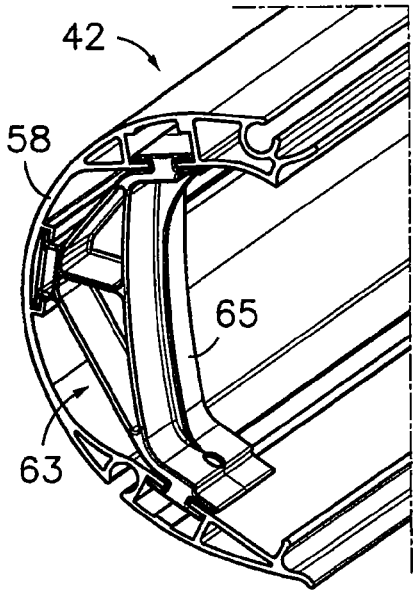
FIG. 5 is a perspective view showing the reinforcing part of FIG. 3 internally fixed to a wall of the load bar.

FIG. 4 shows a reinforcing part 63 adapted to be internally fixed to the closing wall 58 of the load bar 42. FIG. 5 shows said reinforcing part 63 installed in a lower region of the closing wall 58 of the load bar 42. The reinforcing part defines a strut 65 which is arranged between an upper region and a lower region of the closing wall 58 reinforcing it against bending, torsion and a tendency to be squashed, which is especially useful in very long load bars 42. In the closing wall 58 of the load bar 42 there can be assembled one or more of such reinforcing parts 63 in mid positions in which they do not interfere with the foldable arms 24.

Figure 6:
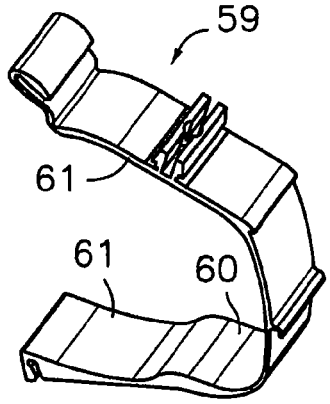
FIG. 6 is a rear perspective view of a positioning part intended for being internally fixed on a wall of the load bar.

FIG. 6 shows a positioning part 59 adapted to be internally fixed to the closing wall 58 of the load bar 42. Two of these positioning parts 59 are preferably assembled in the load bar 42 and located in positions in which fitting configurations 60 of the positioning parts 59 cooperate with portions of the foldable arms 24 to keep the foldable arms 24 in a certain position inside the case 40 in the folded awning situation. The positioning parts 59 define slides 61 adapted to direct the foldable arms 24 in a sliding manner up to said fitting configurations 60 during a closing operation of the case. One of these positioning parts 59 is shown assembled in the load bar 41 in FIGS. 7A-7C. The closing wall 58 of the load bar 42 is preferably formed from at least one extruded profile of a lightweight metal material, such as an aluminium alloy, whereas the reinforcing parts 63 and positioning parts 59 are preferably molded from a plastic material or a relatively ductile material that reduces the friction and makes the translational movement of the arms easier.

Figure 7A:
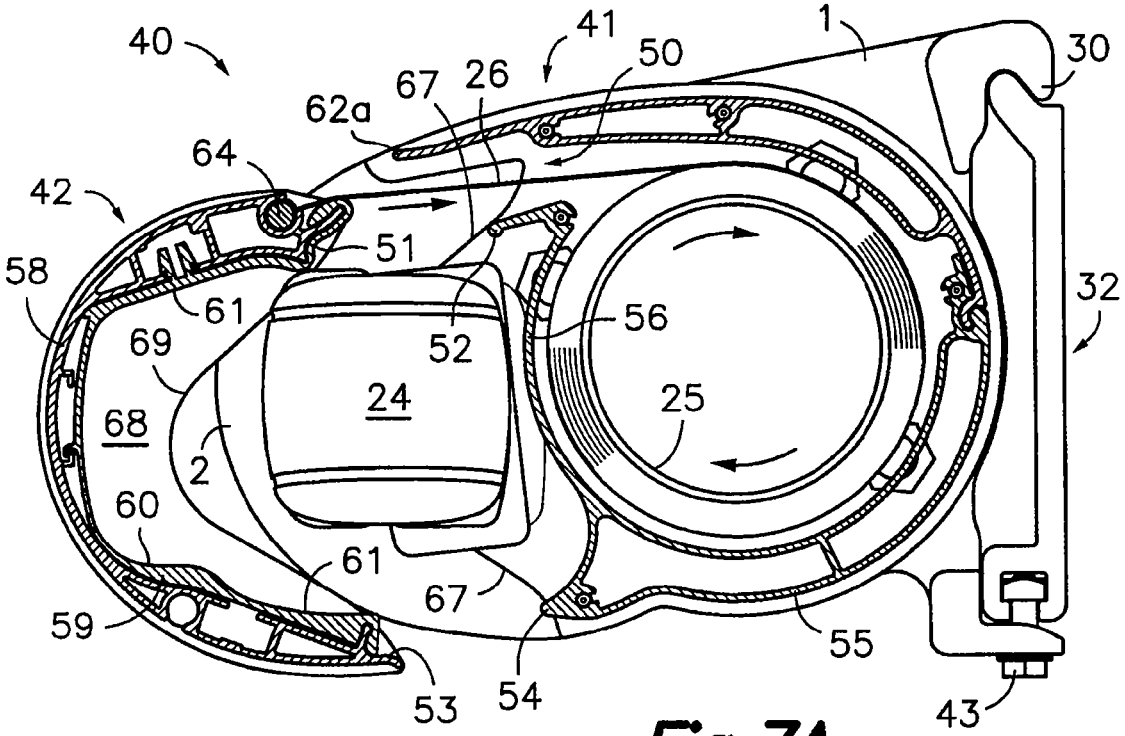
FIGS. 7A-7C are cross-sectional views illustrating a sequence of different positions of the load bar with respect to the housing in a final stage of a closing operation of the case.
Figure 7B:
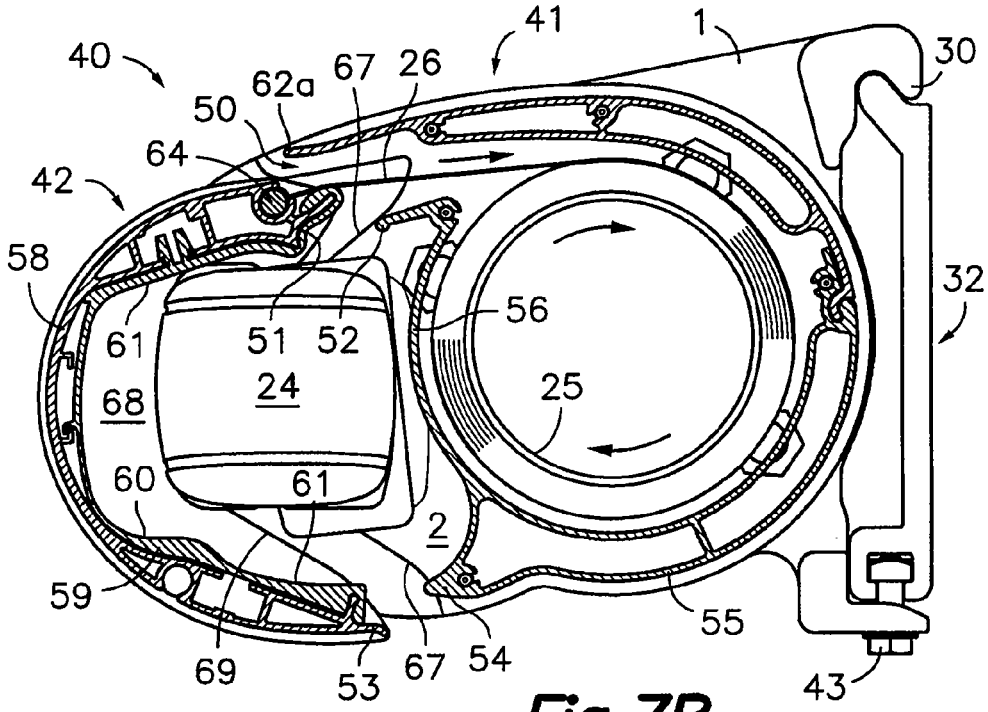
Figure 7C:
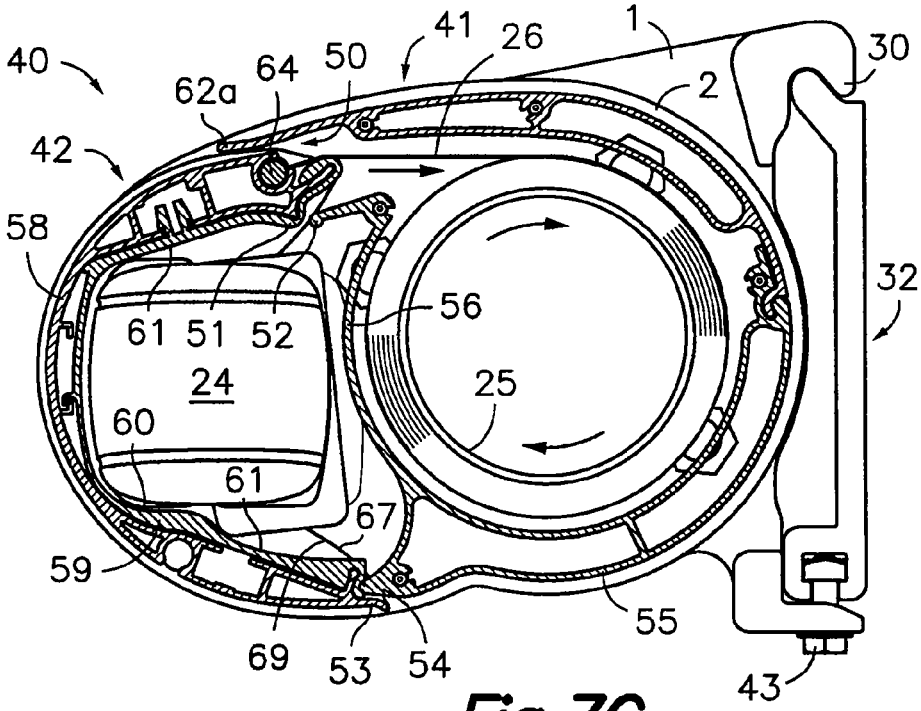

Several positions in a final stage of the closing operation of the case are shown in the sequence of views of FIGS. 7A-7C. In FIG. 7A, a rotation of the winding tube 25 in the suitable direction winds the canvas 26 around the winding tube 25 and the canvas 26 pulls the load bar 41 towards the housing 42. The mentioned elastic means applied to the foldable arms 24 exert a suitable force to keep the canvas under tension whichever the position of the load bar 42, therefore, during the closing operation, the canvas 26 pulls the load bar against the force of said elastic means. Up to this point, the path of the closing movement of the load bar 42 has been determined by the folding movement of the foldable arms 24. FIG. 7B shows a later position in which the load bar 42 is closer to the housing 41. In this position, one part of the foldable arms 24 has made contact with several of the mentioned slides 61 of the positioning parts 59 and the foldable arms 24 slide towards said fitting configurations 60 as the case 40 is closed. FIG. 7C shows the final stage of the closing operation. The first and second coupling configurations 51, 53 of the load bar 42 as well as the first and second coupling edges 52, 54 of the housing 41 are arranged such that during this final stage of the closing operation, the second coupling configuration 53 of the load bar 42 is first coupled to the second coupling edge 54 of the housing 41, forming a fulcrum line. A subsequent pulling force exerted by the canvas 26 on the fixing configuration 64, which is far from the second coupling configuration 53, causes a small rotation of the load bar 42 about said fulcrum line until the first coupling configuration 51 is coupled to the first coupling edge 52 of the housing 41, completing the closing operation of the case 40.

End covers 68 provided with contours 69 facing the housing 41 are fixed at the ends of the load bar 42, and the end plates 2 comprise on their inner side, i.e. on the side opposite to the support part 1, in addition to a projection (not shown) with which the corresponding proximal end of the foldable arm is articulated, ramps 67 adapted to cooperate with said contours 69 of the end covers 68 of the load bar, such that in the final stage of the closing operation of the housing 40 shown in FIG. 7C, the cooperation of said ramps 67 with the contours 69 contributes to accurately driving the approaching movement of the load bar 42 until the initial coupling of the second coupling configuration 53 of the load bar 42 with the second coupling edge 54 of the housing 41 facilitating the subsequent coupling of the first coupling configuration 51 of the load bar 42 with the first coupling edge 52 of the housing 41. In the closed position shown in FIG. 7C, the upper front edge 62*a* of the outer wall 55 of the housing 41 forms a roof protecting the longitudinal opening 50, which is now virtually closed by the load bar 42, from the entrance of rainwater.

Figure 8:
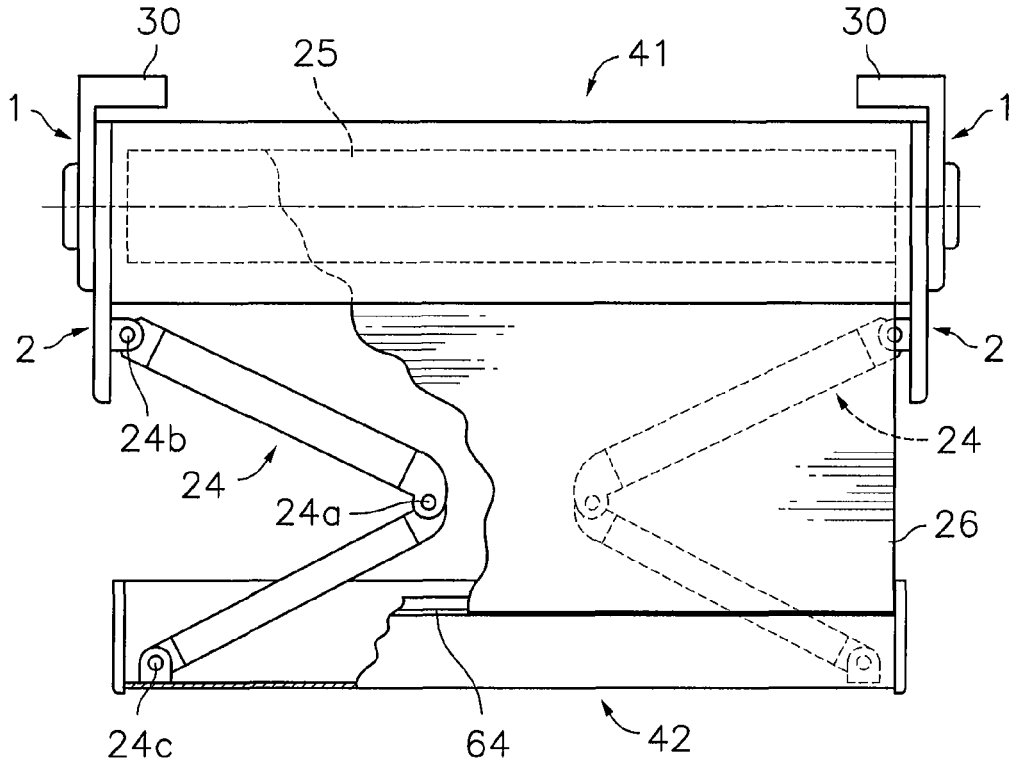
FIG. 8 is a diagrammatical top plan view of the awning case assembly in a partially open position with cut-out parts to better show the connection of foldable arms to a housing and a load bar.

FIG. 8 shows the awning case assembly 40 comprising the housing 41 and the load bar 42, the pair of foldable arms 24 and the canvas 26. The housing 41 is attached at its ends to two end plates 2 rotatably coupled to corresponding support parts 1 having engaging configurations 30 attached to anchoring parts 32 fixed to a wall or another structure (see also FIGS. 7A-7C). The canvas 26 has a rear edge fixed to a winding tube 25 rotatably mounted within the housing 41 and a front edge fixed to a fixing configuration 64 formed along the load bar 42. Each foldable arm 24 is conventionally comprised of two sections hingedly connected to each other at 24*a* and has a proximal end hingedly connected at 24*b* to the corresponding end plate 2 which in turn is attached to the housing 42 and a distal end hingedly connected at 24*c* to the load bar 42.

A person skilled in the art will think of several variations and modifications in the exemplary embodiment shown and described without departing from the scope of the present invention as it is defined in the attached claims.

The invention claimed is:

1. An awning case assembly comprising:

a housing adapted to house a winding tube with a canvas wound thereon, said housing having a longitudinal opening allowing the passage of said canvas; and a load bar having a longitudinal fixing configuration to which a front edge of said canvas is fixed, said load bar being hingedly connected to distal ends of foldable arms having proximal ends hingedly connected to the housing, the load bar being adapted to be coupled to the housing in a folded awning situation, closing said longitudinal opening and covering said foldable arms, the load bar comprising:

a first longitudinal coupling configuration adjacent to said longitudinal fixing configuration and adapted to be coupled to a first longitudinal coupling edge of the housing, and a second longitudinal coupling configuration arranged at a distance from said first coupling configuration and adapted to be coupled to a second longitudinal coupling edge of the housing, said first and second coupling configurations and said first and second coupling edges being arranged such that during a closing operation of the case by winding the canvas, the second coupling configuration of the load bar is first coupled to the second coupling edge of the housing, to form a fulcrum line about which the load bar can rotate under the action of a pulling force exerted by the canvas on the fixing configuration until the first coupling configuration is coupled to the first coupling edge of the housing, wherein, the housing comprises an outer wall surrounding the winding tube and the canvas at the upper, lower and rear sides, and a partition wall surrounding the winding tube and the canvas at the front side except in the area of the longitudinal opening, said partition wall being placed between the canvas wound on the winding tube and the foldable arms in the folded awning situation; and the first coupling edge of the housing is formed at a free upper edge of said partition wall close to an upper front edge of said outer wall and separated therefrom by said longitudinal opening, and the second coupling edge of the housing is formed at a lower front edge of said outer wall.

2. An awning case assembly according to claim 1, wherein the load bar defines an inner hollow facing the partition wall and which can at least partly house the foldable arms in said folded awning situation.

3. An awning case assembly according to claim 2, wherein the load bar comprises an externally convex closing wall defining said inner hollow and having an upper rear edge in which the first coupling configuration of the load bar is located and a lower rear edge in which the second coupling configuration of the load bar is located.

4. An awning case assembly according to claim 1, wherein at least part of said outer wall of the housing is a double wall forming one or more chambers therein.

5. An awning case assembly according to claim 1, wherein inner surfaces of the outer wall and of the partition wall facing the winding bar and the canvas include a coating of a plastic material with a low friction coefficient.

6. An awning case assembly according to claim 3, further comprising at least one reinforcing part internally fixed to said closing wall of the load bar, said reinforcing part forming a strut between an upper part and a lower part of the closing wall.

7. An awning case assembly according to claim 3, further comprising positioning parts internally fixed to said closing wall of the load bar and defining fitting configurations to keep the foldable arms in a predetermined position in the folded awning situation and slides to direct the foldable arms in a sliding manner up to said fitting configurations during a closing operation of the case.

8. An awning case assembly according to claim 1, wherein the housing is formed from at least one extruded profile of a lightweight metal material.

9. An awning case assembly according to claim 8, wherein the housing is formed from two extruded profiles of a lightweight metal material longitudinally connected to one another.

10. An awning case assembly according to claim 1, wherein the load bar is formed from at least one extruded profile of a lightweight metal material.

11. An awning case assembly according to claim 1, further comprising end plates fixed to said housing transversely closing ends thereof, each end plate comprising, on an inner side thereof, a projection traversed by a through hole adapted to house an articulation pin for said hinged connection of said proximal end of a corresponding one of said foldable arms and ramps adapted to cooperate with contours of a corresponding end cover fixed to the corresponding end of the load bar.

* * * * *